US006401286B1

(12) United States Patent
Brenn

(10) Patent No.: US 6,401,286 B1
(45) Date of Patent: Jun. 11, 2002

(54) BRIDGE DECK CONSTRUCTION FORMS

(76) Inventor: Gregory A. Brenn, 1522 Bryden Dr., Akron, OH (US) 44313

( * ) Notice: Subject to any disclaimer, the term of this patent is extended or adjusted under 35 U.S.C. 154(b) by 0 days.

(21) Appl. No.: 09/567,508

(22) Filed: May 8, 2000

(51) Int. Cl.[7] ..... E04G 11/38; E04G 11/48; E01D 19/12

(52) U.S. Cl. ..... 14/73; 404/51; 52/583.1; 52/585.1; 249/189; 249/192

(58) Field of Search ..... 14/2.4, 73, 73.1, 14/77.1; 404/51, 52, 57, 43, 53, 68; 249/189, 192, 47, 6; 52/783.1, 787.1, 589.1, 783.17, 783.14, 583.1, 585.1

(56) References Cited

U.S. PATENT DOCUMENTS 755,122 A * 3/1904 Fisher ..... 52/585.1
876,985 A * 1/1908 Malancon ..... 52/585.1
2,053,135 A * 9/1936 Dalton ..... 14/73
2,184,137 A * 12/1939 Brewer ..... 14/73
2,257,001 A * 9/1941 Davis ..... 52/585.1
3,066,771 A * 12/1962 Wolchuk ..... 14/73
3,260,023 A * 7/1966 Nagin ..... 14/73
3,302,361 A * 2/1967 Oudheusden, Jr. et al. ..... 14/73
4,025,021 A * 5/1977 Stout ..... 249/189
4,453,283 A * 6/1984 Fitzgerald-Smith et al. ... 14/73
4,695,033 A * 9/1987 Imaeda et al. ..... 249/189
4,918,777 A * 4/1990 Ashley ..... 14/73
5,044,601 A * 9/1991 Miller ..... 249/47
5,603,134 A * 2/1997 Whipkey et al. ..... 14/2.4
5,913,340 A * 6/1999 McDonald ..... 14/73
5,979,138 A * 11/1999 Allen ..... 249/47
5,987,680 A * 11/1999 Sakaya ..... 14/73
6,081,955 A * 7/2000 Dumlao et al. ..... 14/73
6,170,105 B1 * 1/2001 Doyle et al. ..... 14/73

* cited by examiner

*Primary Examiner*—Robert E. Pezzuto
*Assistant Examiner*—Alexandra K. Pechhold
(74) *Attorney, Agent, or Firm*—John D. Gugliotta

(57) ABSTRACT

A bridge deck construction form is provided capable of being used in a series of interlocking forms. The system uses an interlocking grid of plastic forms upon which the concrete is poured. The forms have male and female interlocking connectors around their perimeter to allow the forms to lock together end to end and side to side. The top surface of the form is smooth, and a series of hand grip indentations and fork lift fork receiving recess indentations are provided about the vertical perimeter apron to allow for easy handling and manipulation of the forms, whether by hand or by fork-lift, during placement, removal, shipping, storage, transport, or the like.

12 Claims, 6 Drawing Sheets

BRIDGE DECK CONSTRUCTION FORMS

RELATED APPLICATIONS

The present invention was first described in Disclosure Document No. 468,498, filed on Feb. 7, 2000. There are no previously filed, nor currently any co-pending applications, anywhere in the world.

BACKGROUND OF THE INVENTION

1. Field of the Invention

The present invention relates generally to concrete decking on bridges and, more particularly, to a lightweight form decking apparatus for extending between the concrete or steel beams of a bridge structure to facilitate pouring concrete decking on the bridge in a safe, quick and efficient manner.

2. Description of the Related Art

Bridge deck construction and replacement is a never-ending and ongoing process. The forces of crossing traffic coupled with the environment, force repair and/or replacement on a regular basis. If one were to watch this process of bridge deck repair, one would notice the large amount of lumber and plywood used to make forms for the concrete pour. These forms must be joined together using common carpentry techniques which consume a great deal of time. Also, most of the lumber and plywood must be moved into place using manual hand labor. This also takes a good amount of time all of which leads to higher construction costs. At the end of the job, most of the lumber is discarded which results in large waste of wood, forming an environmental impact as well.

In the related art, concrete decking is typically poured on bridges by initially positioning concrete or steel beams on pilings or other supports to span the river, stream, highway, rail road track or other obstacle. Cross-members, commonly called "whalers" are adjustably positioned between the concrete beams at spaced intervals by means of U-bolts spanning the concrete or steel beams and plywood decking is nailed or otherwise attached to the whalers or to spacers positioned on the whalers to provide a support or form at a selected level determined by adjustment of the whalers, for the concrete poured on the bridge to define the bridge decking. After the concrete decking is cured, the plywood forms and spacers are commonly laboriously removed at great expense from the bridge decking. The positioning of the typically 4 ft.‖8 ft. plywood sheets and spacers on the whalers between the concrete or steel beams before pouring of the concrete is also hazardous to the workers, since the workers must traverse the whalers and the beams to both position and fasten the plywood panels in place. This job is both dangerous and time-consuming and results in a considerable delay in completing the highway or road system, of which the bridge is an integral part.

Numerous attempts have been made to correct for the foregoing problems. A search of the prior art did not disclose any patents that read directly on the claims of the instant invention; however, the following references were considered related:

U.S. Pat. No. 5,483,716 issued in the name of Bumaman;

U.S. Pat. No. 5,104,089 issued in the name of Shook et al.; and

U.S. Pat. No. 3,311,939 issued in the name of Yamamoto et al.

U.S. Pat. No. 5,792,552 issued in the name of Langkamp et al. describes a reusable concrete form panel sheeting.

U.S. Pat. No. 5,682,635 issued in the name of Tolliver et al. discloses bridge and road construction and method of removing a worn deck structure.

U.S. Pat. No. 5,533,221 issued in the name of Majnaric et al. describes a method and apparatus for bridge construction.

U.S. Pat. No. 5,309,691 issued in the name of Tolliver et al. disclose shear connected structural units.

U.S. Pat. No. 4,123,031 issued in the name of Hyre describes improvements in concrete roadway slab forming.

And, U.S. Pat. No. 4,087,220 issued in the name of Koss discloses an apparatus for building a concrete bridge superstructure.

Accordingly, it is an object of this invention to provide a new and improved form decking apparatus for temporarily mounting on conventional, adjustable whalers or supports between the beams of bridges to support the concrete decking.

SUMMARY OF THE INVENTION

Therefore, it is an object of the invention to indicate a device of the type disclosed above which avoids the disadvantages inherent in the state of the art.

In particular, the device is to provide a new and improved form decking that aid in the forming and pouring of concrete for a bridge deck.

Briefly described according to the preferred embodiment of the present invention, a series of interlocking forms are provided that aid in the forming and pouring of concrete for a bridge deck. The system uses an interlocking grid of four foot by eight foot plastic forms upon which the concrete is poured. The forms have male and female interlocking tabs around their perimeter to allow the forms to lock together end to end and side to side. The top surface of the form is smooth and a lap joint around part or all of the perimeter's vertical sides provides for a finished smooth look when the invention is removed.

The bottom of the invention is a ribbed design for reinforcing and strength.

The invention is generally lighter than the conventional wood plywood system used in bridge deck construction.

The use of plastic in the present invention is more durable than the plywood and as such permits reuse many times.

The use of bridge deck construction forms of the present disclosure allows for the construction of concrete bridge decks in a manner that is quick, easy and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 5*e* is a front end elevational view according to a fourth alternate embodiment thereof;

DESCRIPTION OF THE PREFERRED EMBODIMENTS

1. Detailed Description of the Figures

Figure 1:
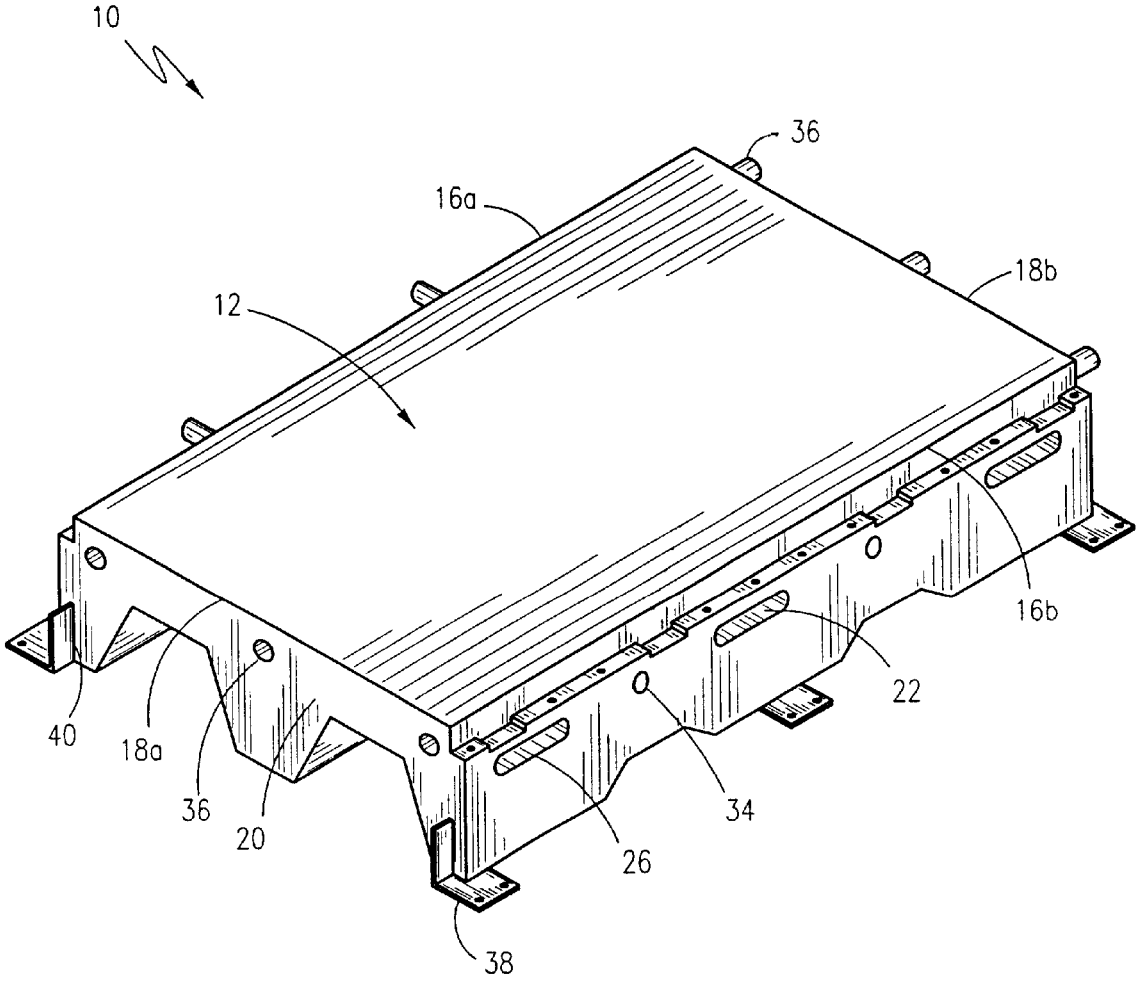
FIG. 1 is a perspective view of a bridge deck construction form according to the preferred embodiment of the present invention.

Referring now to FIG. 1–4, a bridge deck construction form is shown, according to the present invention, generally noted as 10. The form 10 is formed as generally rectangular, interlocking support form having a form upper surface 12 defining a rectangular outer perimeter. The form upper surface 12 is envisioned as having a smooth surface to facilitate releasing of the form from the concrete (as will be described in greater detail below), but can also be made having a non-skid, or textured surface if desired or required. The form 10 itself, due to its geometrically regular shape and structurally integral design, is capable of being formed of plastic or other material capable of injection molding, and therefore can be formed easily of recycled material. Also, it is envisioned that an insulated foam layer 50 (as shown in FIG. 5*b*) can also be easily incorporated above or below the upper surface 12 in situations where the form 10 will not be removed and insulation is desired or required, such as for roofing, flooring, or wall construction.

In further detail, the rectangular outer perimeter of the form 10 is comprised of a first side edge 16*a* parallel to a second side edge 16*b*, and both perpendicular to a first end edge 18*a* parallel to a second end edge 18*b*. Extending vertically downward from each end edge 18*a*, 18*b* at the outer perimeter is a vertical attachment apron 20. Similarly, extending vertically downward from each side edge 16*a*, 16*b* at the outer perimeter is a vertical alignment apron 22.

Figure 2:
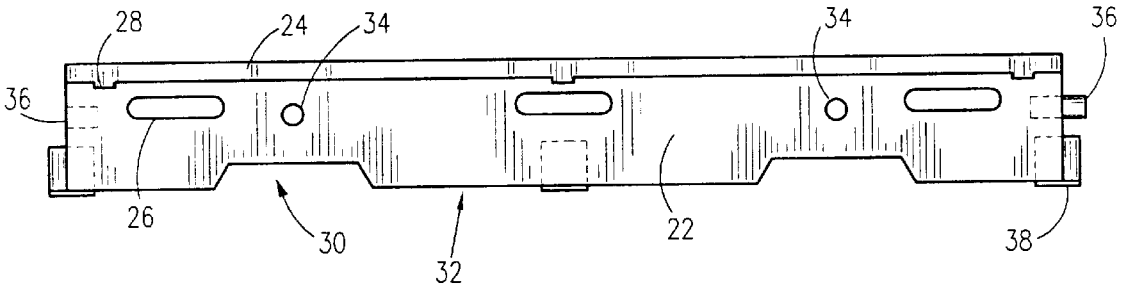
FIG. 2 is a side elevational view thereof.
Figure 3:
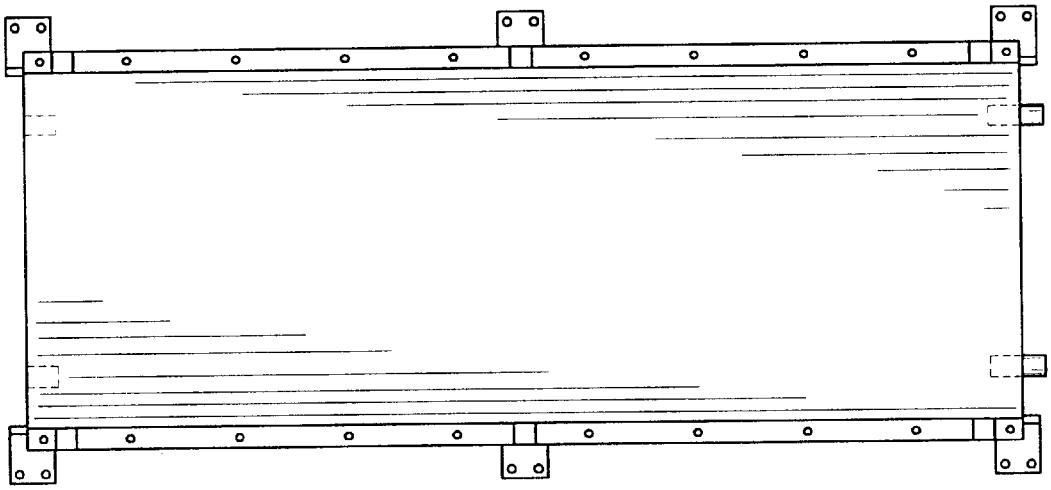
FIG. 3 is a top plan view thereof.
Figure 4:
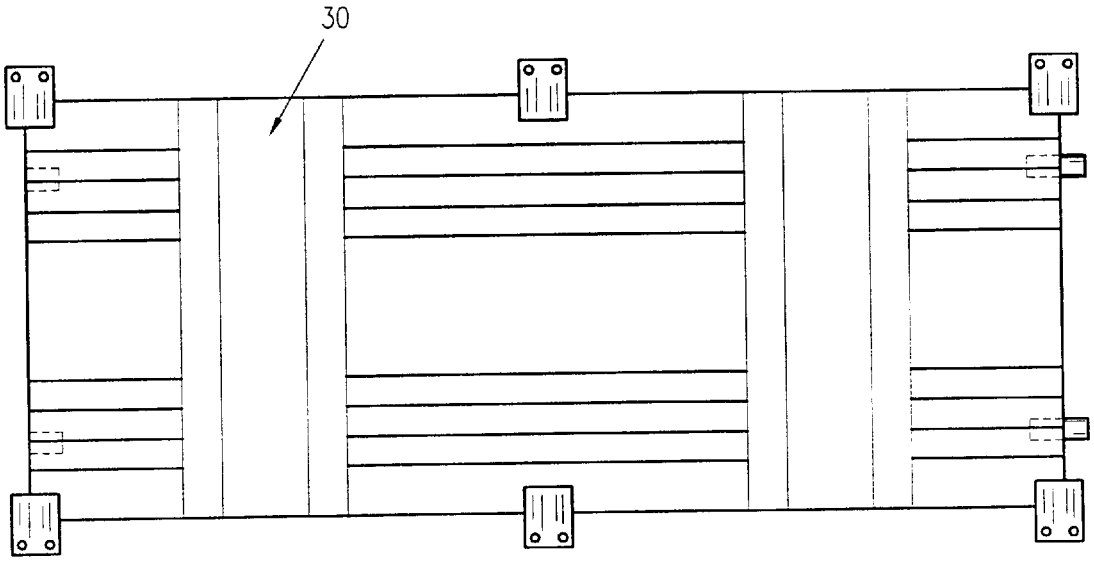
FIG. 4 is a bottom plan view thereof.

Referring now in greater detail in conjunction with FIG. 2 and FIG. 4, each vertical alignment apron 22 forms a number of structural, functional features that form important elements of the present invention. For example, the use of a "honch" board, or filler board is a widespread practice for providing surface continuity between the form upper surface 12 and the upper surface of the beam flange 58 (see FIG. 7). Accordingly, a honch board/filler board receiving slot 24 is formed as an angular recess between the upper surface 12 and the vertical alignment apron 22 and running the entire linear length of any or all of each side edge 16*a*, 16*b*. This notch 24 is also depicted more clearly in FIG. 5*a*. Further, a series of hand grip indentations 26 are spaced along each vertical alignment apron 22. Each hand grip indentation 26 is formed inward from the outer surface of the vertical alignment apron 22, and provides a gripping surface for a user to hand manipulate the form 10 into its proper position. Similarly, a series of aligned removal notches 28 are spaced along each vertical alignment apron 22 are formed along each vertical alignment apron 22. Further, a fork receiving recess indentation 30 is shown, in conjunction with FIG. 4, as a raised void above the lower edge 32 of the vertical alignment apron 22 and extending as a channel along the entire width of the form 10. Each fork receiving recess indentation 30 is designed and placed to allow for a gripper surface for a user to insert a fork lift lifting tine for manipulation of the form 10 during stocking, storing, transporting, and the like. Finally, at least one, but preferably a plurality of form alignment means 34 are formed along each vertical alignment apron 22 and spaced identically in such a manner that each alignment means 34 coincide and interact when the first side edge 16*a* of one deck construction from 10 is placed parallel and aligned to the second side edge 16*b* of a second construction form 10.

Figure 5A:
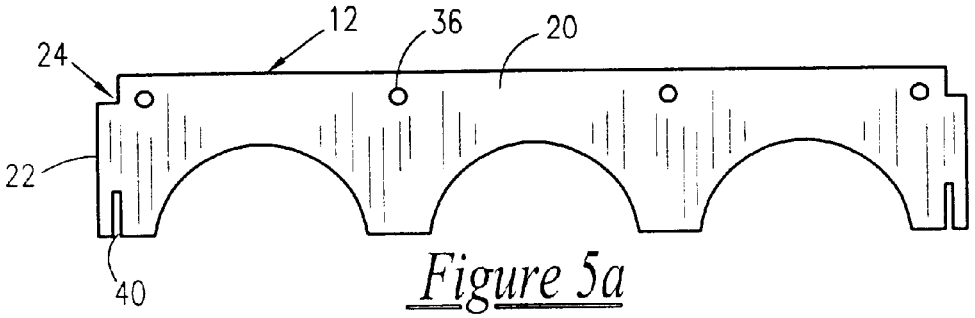
FIG. 5*a* is a front end elevational view thereof.
Figure 5B:
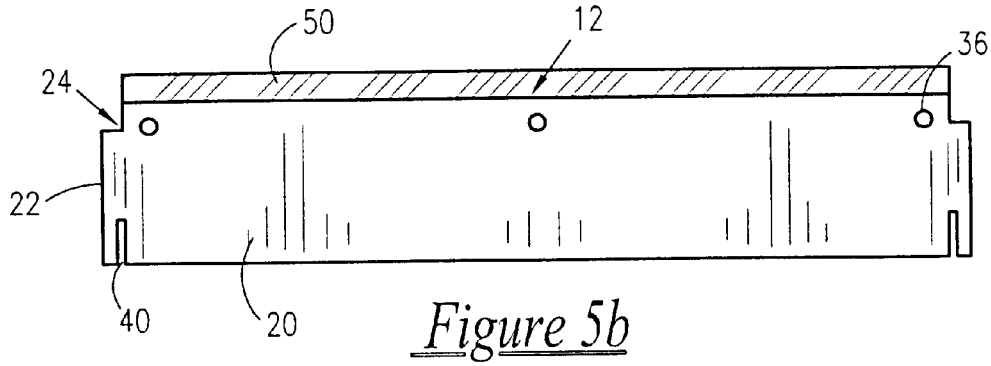
FIG. 5*b* is a front end elevational view according to a first alternate embodiment thereof.
Figure 5C:
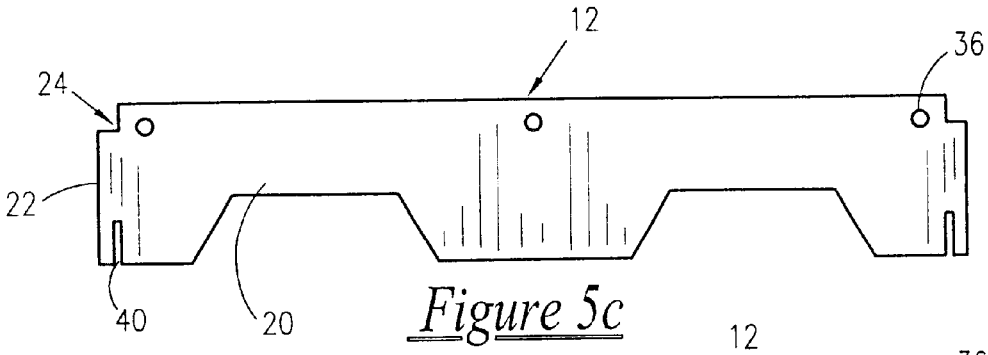
FIG. 5*c* is a front end elevational view according to a second alternate embodiment thereof.
Figure 5D:
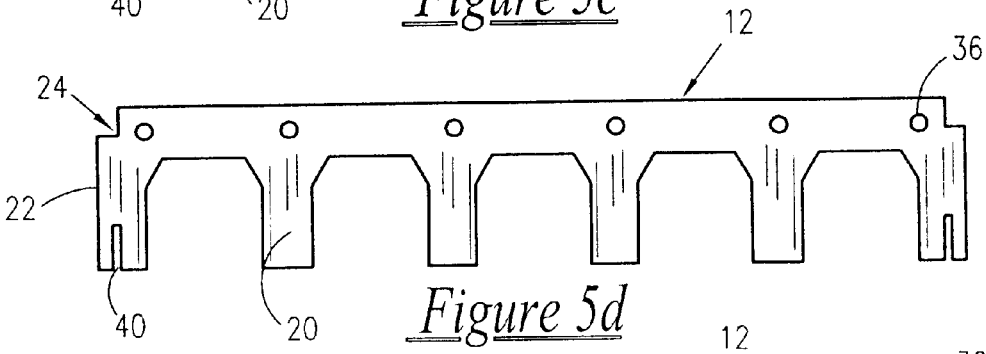
FIG. 5*e* is a front end elevational view according to a third alternate embodiment thereof.
Figure 5E:
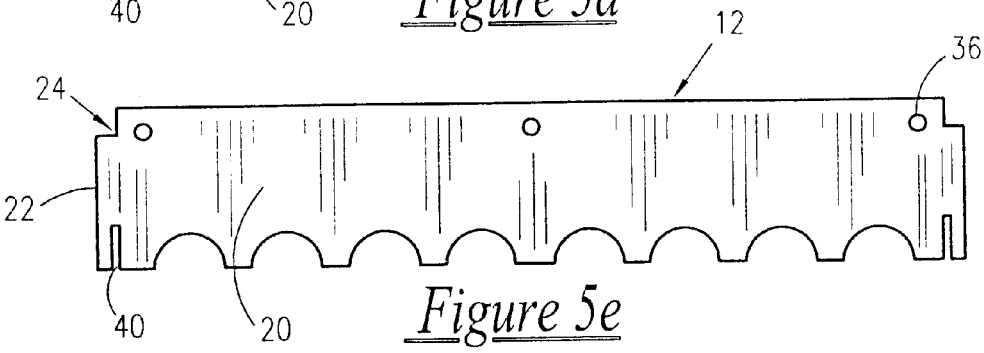

Referring now in greater detail in FIG. 1 and FIG. 2, in conjunction with FIG. 5*a* through 5*e*, each vertical attachment apron 20 forms a plurality of form adjacent form attachment means 36 are formed along each vertical alignment apron 22 and spaced identically in such a manner that each alignment means 36 coincide and interact when the first end edge 18*a* of one deck construction from 10 is placed parallel and aligned to the second end edge 18*b* of a second construction form 10. Finally, as shown in FIG. 5*a* through 5*b*, the front end elevational view of various alternate embodiment are shown depicting various configurations for each vertical attachment apron 20. These various embodiment are depicted by way of example, and not by way of limitation, to indicate potential different embodiments to provide differing aesthetics, as well as support structure for various levels of vertical support structural integrity.

In any embodiment, it is envisioned that an "L" bracket fastener 38 will be utilized as described in greater detail below. To accommodate accepting each fastener 38, a fastener receiving slot 40 is formed along each vertical attachment apron 20. For purposes of disclosing the presently envisioned best mode of the invention, it is felt that each fastener receiving slot 40 will be formed two inches in vertical, linear length, and at a location two inches inwardly offset from the vertical attachment apron 22. This regular spacing and regular sizing adds to the modular, interlocking nature generally exhibited by the present invention.

Finally, for purposes of disclosing the presently envisioned best mode of the invention, it is felt that each adjacent form attachment means 36 and form alignment means 34 would be best practices as similar, interchangeable, and interlocking male attachment dowels and female receiving apertures. As such, it is felt that each first side edge 16*a* and each first end edge 18*a* would form the female receiving apertures in a regularly space, linearly aligned manner about the vertical alignment apron 22 and vertical attachment apron 20, respectively. In conjunction with these receiving apertures, it is felt that each second side edge 16*b* and each second end edge 18*b* would form the male attachment dowel in a regularly spaced, linearly aligned and corresponding manner about the vertical alignment apron 22 and vertical attachment apron 20, respectively.

In this manner, it is anticipated that the forms 10 can be used in a modular, interlocking, replaceable and reusable fashion as described below.

2. Operation of the Preferred Embodiment

Figure 6:
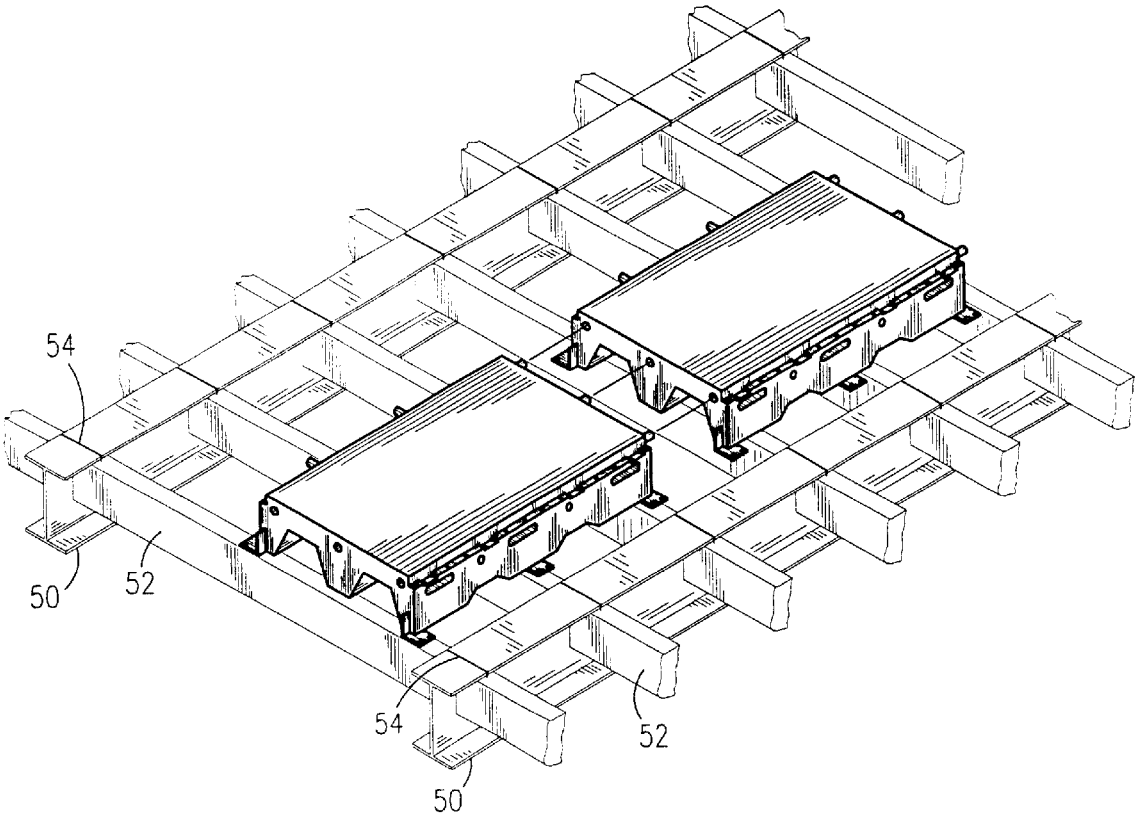
FIG. 6 is a top perspective view of a bridge deck construction form according to the preferred embodiment of the present invention shown in position upon a bridge deck.
Figure 7:
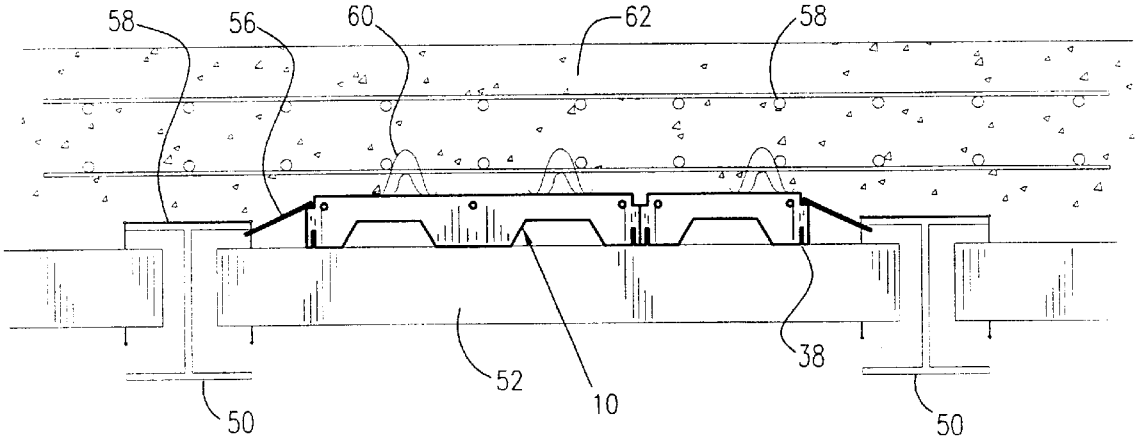
FIG. 7 is a side elevational view of the bridge deck construction form of FIG. 6 shown in position upon a bridge deck.

To use the present invention, when replacing a bridge deck, the old deck is removed, leaving the steel or concrete beams 50 (as shown best in FIG. 6 and FIG. 7). The beams 50 are usually spaced 7 feet, 6 inches apart, 8 feet apart, or 9 feet apart on centers, suggesting the need for different sized forms. The whalers 52 are placed or hung from the beams 50 by hanger brackets 54. The form 10 is then placed on top of the whaler 52 and secured to the whaler 52 by the "L" brackets 38. Once one form 10 is placed, other forms 10 are connected to it by the adjacent form attachment means 36, end-to-end, and are aligned side-to-side by connecting adjacent forms 10 utilizing the form alignment means 34, until all deck forms are in place. The deck is then adjusted to its proper height and honch boards 56 are placed from the receiving slot 24 to the beam flange 58.

From this point, steel reinforcing bars 58 are laid on support chairs 60, and then concrete 62 is poured. After the concrete 62 has hardened, whalers 52 are lowered and removed, and the forms 10 are removed by prying, if necessary, by inserting a prybar or hammer into the removal notch 28 on the forms. The forms 10 are then separated at the connection means 34, 36 and then lowered to the ground. The forms 10 can then be easily cleaned with water, and made ready for reuse.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A bridge deck construction form comprising:

a generally rectangular, interlocking support form having a form upper surface defining a rectangular outer perimeter comprised of a first side edge parallel to a second side edge and both said side edges perpendicular to a first end edge parallel to a second end edge;

a vertical attachment apron extending vertically downward from each said end edge at said outer perimeter;

a vertical alignment apron extending vertically downward from each said side of said outer perimeter, wherein each vertical alignment apron forms a honch board/filler hoard receiving slot, formed as an angular recess between the upper surface and the vertical alignment apron and running the entire linear length of any of each said side edge; and plurality of form attachment means formed along each said vertical alignment apron and spaced in such a manner that each said form attachment means coincide and interact when said first end edge of one bridge deck construction from is placed parallel and aligned to said second end edge of a second bridge deck construction form.

2. The bridge deck construction form of claim 1, wherein each vertical alignment apron forms a series of hand grip indentations spaced along each vertical alignment apron, thereby providing a gripping surface for a user to hand manipulate the form into its proper position.

3. The bridge deck construction form of claim 2, wherein each hand grip indentation is formed inward from the outer surface of the vertical alignment apron.

4. The bridge deck construction form of claim 1, wherein each vertical alignment apron forms a series of aligned removal notches spaced along each vertical alignment apron and formed along each vertical alignment apron.

5. The bridge deck construction form of claim 1, wherein each vertical attachment apron forms a fork receiving recess indentation as a raised void above the lower edge of the vertical alignment apron and extending as a channel along the entire width of the form, wherein each fork receiving recess indentation is designed and placed to allow for a gripper surface for a user to insert a fork lift lifting tine for manipulation of the form.

6. The bridge deck construction form of claim 1, wherein each vertical alignment apron forms a plurality of form alignment means along each vertical alignment apron and spaced in such a manner that each alignment means coincides and interacts when the first side edge of one bridge deck construction from is placed parallel and aligned to the second side edge of a second bridge deck construction form.

7. The bridge deck construction form of claim 1, wherein said form upper surface is made having a non-skid, textured surface.

8. The bridge deck construction form of claim 1, wherein said form is formed of a material capable of injection molding.

9. The bridge deck construction form of claim 1, further comprising an insulated foam layer incorporated below said upper surface.

10. The bridge deck construction form of claim 1, wherein each vertical alignment apron forms a fastener receiving slot for accepting a fastener, each fastener receiving slot formed along each vertical attachment apron, said bridge deck construction form further comprising:

an "L" shaped fastener.

11. The bridge deck construction form of claim 10, wherein each fastener receiving slot is formed two inches in vertical, linear length, and at a location two inches inwardly offset from each vertical attachment apron.

12. A bridge deck construction form comprising:

a generally rectangular, interlocking support form having a form upper surface defining a rectangular outer perimeter comprised of a first side edge parallel to a second side edge and both said side edges perpendicular to a first end edge parallel to a second end edge;

a vertical attachment apron extending vertically downward from each said end edge at said outer perimeter;

a vertical alignment apron extending vertically downward from each said side of said outer perimeter, wherein each vertical alignment apron forms a plurality of form alignment means along each vertical alignment apron and spaced in such a manner that each alignment means coincides and interacts when the first side edge of one bridge deck construction from is placed parallel and aligned to the second side edge of a second bridge deck construction form; and plurality of form attachment means formed along each said alignment apron and spaced in such a manner that each attachment means coincide and interact when said first end edge of one bridge deck construction from is placed parallel and aligned to said second end edge of a second bridge deck construction form, wherein said form attachment means and form alignment means comprise interchangeable and interlocking male attachment dowels and female receiving apertures, respectively, and wherein said first side edge and said first end edge form said female receiving apertures in a regularly space, linearly aligned manner about the vertical alignment apron and vertical attachment apron, respectively, and each second side edge and each second end edge support and connect to said male attachment dowel in a regularly spaced, linearly aligned and corresponding manner about the vertical alignment apron and vertical attachment apron, respectively.

* * * * *